US007598824B2

(12) United States Patent
Callewaert

(10) Patent No.: US 7,598,824 B2
(45) Date of Patent: Oct. 6, 2009

(54) SPLITTER/COMBINER CIRCUIT

(75) Inventor: Clyde Maynord Callewaert, Shelby Township, MI (US)

(73) Assignee: M/A-COM Technology Solutions Holdings, Inc., Lowell, MA (US)

( * ) Notice: Subject to any disclaimer, the term of this patent is extended or adjusted under 35 U.S.C. 154(b) by 70 days.

(21) Appl. No.: 11/599,541

(22) Filed: Nov. 14, 2006

(65) Prior Publication Data

US 2007/0216495 A1 Sep. 20, 2007

Related U.S. Application Data

(60) Provisional application No. 60/782,387, filed on Mar. 15, 2006, provisional application No. 60/830,971, filed on Jul. 14, 2006.

(51) Int. Cl.
*H01P 5/12* (2006.01)

(52) U.S. Cl. ..... 333/134; 333/126

(58) Field of Classification Search ..... 333/125–129, 333/134

See application file for complete search history.

(56) References Cited

U.S. PATENT DOCUMENTS 5,652,599 A * 7/1997 Pitta et al. ..... 343/858
6,118,355 A * 9/2000 Pelz et al. ..... 333/134
6,320,478 B1 * 11/2001 Sims, III ..... 333/127
6,664,932 B2 12/2003 Sabet et al.
6,906,669 B2 6/2005 Sabet et al.
6,917,340 B2 7/2005 Lindenmeier
6,972,637 B2 * 12/2005 Nation ..... 333/104
2003/0030508 A1 2/2003 Wangsvick et al.
2003/0214447 A1 11/2003 Sasagawa et al.
2005/0012676 A1 * 1/2005 McCarthy et al. ..... 343/853

FOREIGN PATENT DOCUMENTS

DE 829 318 C2 1/1952
FR 2 532 120 A3 2/1984
WO WO 97/10621 A 3/1997

* cited by examiner

*Primary Examiner*—Robert Pascal
*Assistant Examiner*—Kimberly E Glenn
(74) *Attorney, Agent, or Firm*—Christopher P. Maiorana, PC

(57) ABSTRACT

A circuit for combining/splitting first and second RF signals having different wavelengths of x and y, respectively, the circuit comprising: (a) first and second transmission portions coupled at an intersection, the first transmission portion comprising at least two intersecting transmission lines, each having a length which is an odd multiple of about ¼ y, the second transmission portion comprising at least two intersecting transmission lines, each having a length which is an odd multiple of about ¼ x; and (b) first, second and third ports, the first port located at the first transmission portion, the second port located at the intersection of the first and second transmission portions, and the third port being located at the second transmission portion, the first and second ports being electrically coupled, and the second and third ports being electrically coupled.

29 Claims, 13 Drawing Sheets

SPLITTER/COMBINER CIRCUIT

CROSS REFERENCE

This application claims priority to U.S. Provisional Application No. 60/782,387, filed Mar. 15, 2006, and U.S. Provisional Application No. 60/830,971, filed Jul. 14, 2006, which are hereby incorporated herein by reference.

FIELD OF INVENTION

The present invention relates to circuitry for combining/splitting different wavelength signals and, more specifically, to a radio frequency (RF) signal diplexer for use with multi-function antennas.

BACKGROUND OF INVENTION

The proliferation of vehicular wireless communication services continues to challenge both original equipment manufacturers (OEMs) and their suppliers to innovate cost effective antenna solutions. Specifically, these emerging services operate on a wide range of frequencies and thus necessitate the development of multiband antenna systems to mitigate cost and improve esthetics. Optimal solutions provide multiband operation by clever consolidation of multiple antennas into a single unit.

An automotive telematics antenna, which combines AMPS (American Mobile Phone Standard), PCS (Personal Communication Service) and GPS (Global Positioning System) services into a single unit, is an example of a consolidated multiband antenna. Moreover, the recent addition of Satellite Digital Audio Radio System, SDARS, has prompted the development of a quad-band antenna adding SDARS to telematics functions.

While these multiband antennas offer many advantages to OEM's, they nevertheless require dedicated coaxial cables for each function. The additional coaxial cables impact routing, location options, increase hole diameter for roof-mounted applications while increasing cost and complexity.

Therefore, there is a need to combine functions onto fewer coaxial cables to reduce the number of cables used. For example, the elimination of even one coaxial cable is significant as it means an OEM can save typically three (3) meters of coaxial cable per vehicle. The present invention fulfills this need among others.

SUMMARY OF INVENTION

One aspect of the invention is a circuit which combines/splits signals having different wavelengths x, y by relying on their different propagation characteristics in the circuit. In a preferred embodiment, the circuit comprises: (a) first and second transmission portions coupled at an intersection, the first transmission portion comprising at least two intersecting transmission lines, each having a length which is a multiple of about ¼ y, the second transmission portion comprising at least two intersecting transmission lines, each having a length which is a multiple of about ¼ x; and (b) first, second and third ports, the first port located at the first transmission portion, the second port located at the intersection of the first and second transmission portions, and the third port being located at the second transmission portion, the first and second ports being electrically coupled, and the second and third ports being electrically coupled.

In a more preferred embodiment, the circuit comprises (a) a substrate; (b) first and second transmission lines intersecting on the substrate; (c) first, second and third ports on the substrate, the first port disposed at one end of the first transmission line, the second port being disposed at the intersection of the first and second transmission lines, the third port being disposed at the end of the second transmission line; (d) first and second stub transmission lines on the substrate, each having a free end and a connected end, the connected end of the first stub transmission line being connected to the first transmission line proximate the first port, the connected end of the second stub transmission line being connected to the second transmission line proximate to the third port; and (e) wherein the first transmission line and the first stub transmission line having a length which is a multiple of about ¼ y±<⅛ y, the second transmission line and the second stub transmission line having a length which is a multiple of ¼ x±<⅛ x.

Another aspect of the invention is method of combining/splitting signals having different wavelengths x, y by relying on their different propagation characteristics in the circuit. In a preferred embodiment, the method combines/splits the signals using a circuit having first and second transmission portions, and first, second and third ports, the first port located at the first transmission portion, the third port being located at the second transmission portion, and the second port being between the first and second transmission portions, the method comprising: (a) introducing a first RF signal at one of the first port or the second port; (b) forming a first standing wave of the first RF signal in the second transmission portion, thereby preventing the first RF signal from propagating through the second transmission portion and out of the third port; and (c) outputting the first RF signal at the other of the first port or the second port.

DETAILED DESCRIPTION OF PREFERRED EMBODIMENTS

The present invention provides a circuit that combines/splits signals of different wavelengths by relying on their different propagation characteristics in the circuit. Specifically, the circuit comprises two adjoining portions with a port located in each portion as well as one, a common port, at the junction of the two portions. Each portion performs two functions. First, it functions to couple its port with the common port for one signal, and, second, it functions to establish high impedance upon introduction of the other signal. Preferably, the portion establishes high impedance by forming a standing wave of the other signal, which significantly reduces the other signal's ability to propagate within the portion and reach its port. Each portion therefore is configured to couple one signal port-to-port, but to reflect the other signal. Preferably, this dual functionality is achieved passively with little or no discrete components such as filters that can introduce significant insertion loss to the circuit.

Therefore, the circuit of the present invention is designed such that, rather than selectively pass band filtering signals such as SDARS and GPS on their respective branches, the circuit rejects the unwanted band by presenting high impedance at the common port, making the circuit appear as a "two port" through for each signal.

This circuit provides a number of important benefits. First, it provides an elegant solution to combine two or more signals on a given line, thereby reducing the number coaxial cables used in automotive antenna applications. Second, since it preferably does not use discrete components, its insertion loss tends to be lower than that of traditional splitter/combiner circuits. Third, the circuit comprises print distributed elements, which are very precise, yet relatively inexpensive to produce in high volume. Still other benefits will become apparent to those of skill in the art in light of this disclosure.

Figure 1:
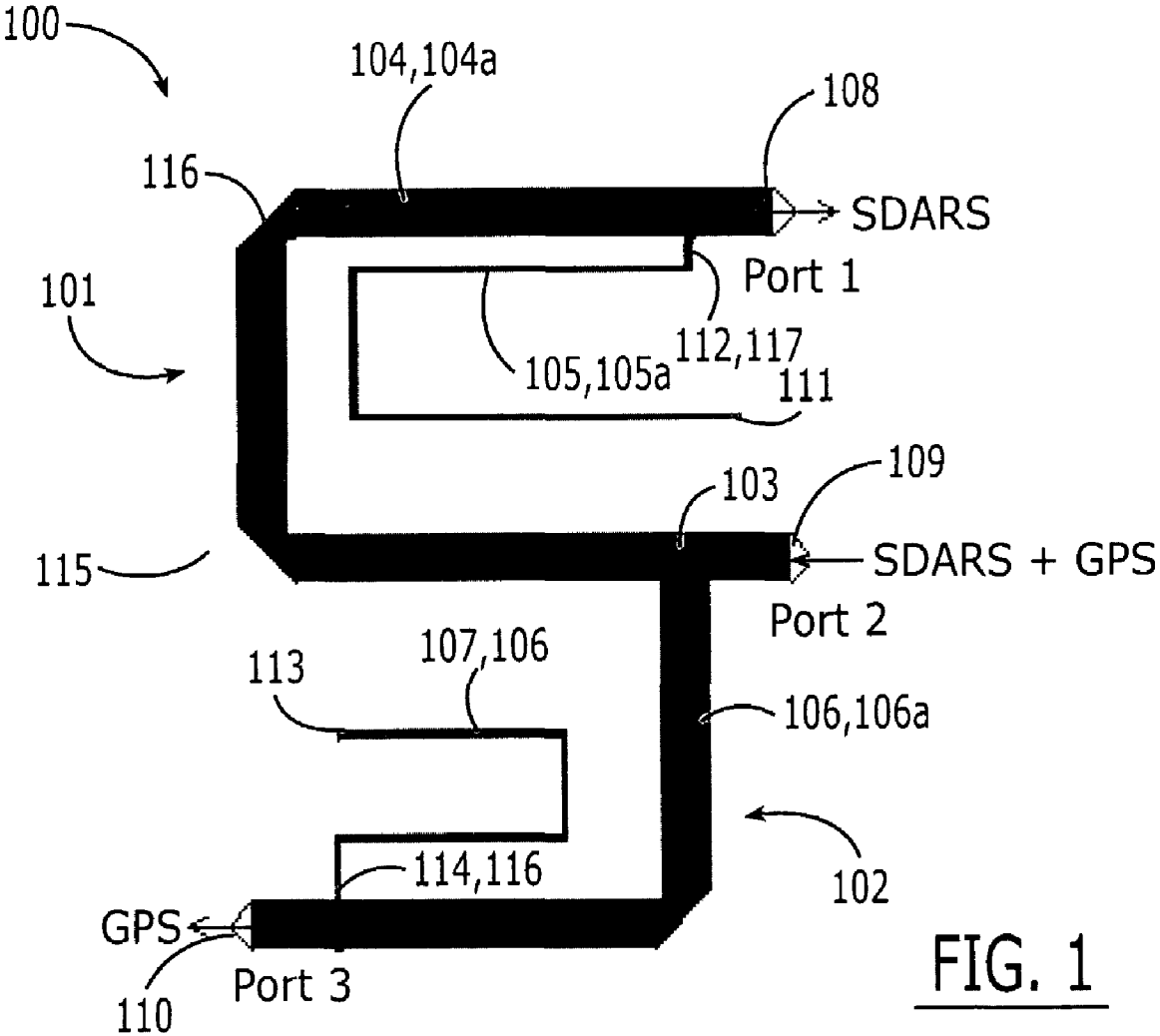
FIG. 1 shows a printed diplexer layout of the present invention.

Referring to FIG. 1, a circuit 100 for combining/splitting first and second RF signals having different wavelengths of x and y, respectively, is shown. It should be understood that the "wavelength" as used herein refers to the guided wavelength in the transmission line as opposed to a "free space" wavelength. The circuit 100 comprises: (a) first and second transmission portions 101, 102, coupled at an intersection 103, the first transmission portion 101 comprising at least two intersecting transmission lines 104, 105, each having a length which is a multiple of about ¼ y, the second transmission portion 102 comprising at least two intersecting transmission lines 106, 107, each having a length which is a multiple of about ¼ x; and (b) first, second and third ports 108, 109, 110, the first port 108 located at the first transmission portion 101, the second port 109 located at the intersection 103 of the first and second transmission portions 101, 102, and the third port 110 being located at the second transmission portion 102, the first and second ports 108, 109 being electrically coupled, and the second and third ports 109, 110 being electrically coupled. Preferably, there are no filters along the coupling between the first and second ports and the second and third ports. Each of these elements is discussed in detail below.

Each transmission portion 101, 102 serves two purposes. The first and relatively straight forward purpose is to couple the port of the transmission portion to the common or second port for a particular signal. The other purpose is more complex and requires the transmission portion to establish high impedance upon introduction of the other signal. Preferably, the transmission portion establishes high impedance by forming a standing wave of the other signal. This high impedance reflects the other signal or otherwise significantly reduces its ability to propagate within the transmission portion and reach the port within. Each transmission portion therefore is configured to couple one signal port-to-port, but reflect the other signal.

Although different techniques and configurations can be used to perform the dual function of coupling one frequency and reflecting another, preferably this is accomplished with no discrete or lumped components. That is, in a preferred embodiment, the coupling and reflective properties of the transmission portion is dictated largely, if not entirely, by the geometry and configuration of transmission lines within the transmission portion.

Applicant recognizes that the circuit can be configured to exploit the wavelength difference between the signals such that it behaves differently for one signal than it does for another. To this end, applicant has configured the circuit to create a standing wave at one frequently but allow the other signal to pass. It is well known that a standing wave will reflect any signal having approximately the same or odd multiples of the same wavelength. The standing wave is created preferably by creating an interruption point along the transmission path. The interruption point is preferably the junction of the main transmission line and a stub transmission line. The lengths of the main and stub transmission lines are an odd multiple of about ¼ the wavelength to be reflected.

More specifically, referring to FIG. 1, the two intersecting transmission lines of the first transmission portion comprise at least a first transmission line 104*a* and a first stub transmission line 105*a* having a free end 111 and a connected end 112. The first port 108 is disposed at one end of the first transmission line 104*a* and the second port 109 is disposed at the other end of the first transmission line 104*a*. The connected end 112 of the first stub transmission line 105*a* is connected to the first transmission line 104*a* proximate the first port 108. Likewise, the at least two intersecting transmission lines of the second transmission portion comprises at least a second transmission line 106*a*, and a second stub transmission line 107*a* having a free end 113 and a connected end 114. The third port 110 is disposed at one end of the second transmission line 106*a* and the second port 109 is disposed at the other end of the second transmission line 106*a*. The connected end 114 of the second stub transmission line 107*a* is connected to the second transmission line 106*a* proximate the third port 110.

It should be understood that, from a practical standpoint, the ability of the transmission portion to couple one frequency while creating a standing wave for the other will likely be more of an optimization/compromise than an absolute. That is, it is unlikely that the wavelengths of the two signals will be related by a ½ multiple—e.g., y is a multiple of ½x—as is required for a perfect circuit in which the coupling of one signal and the reflection of the other will be theoretically absolute. Rather, the circuit 100 is likely to strike a compromise between coupling and reflecting based on the relative importance of the desired insertion loss and isolation. In other words, if high isolation is desired over insertion loss, the transmission portion may be configured to efficiently create a standing wave for one signal even though it may also interrupt the propagation of the signal too. On the other hand, if low insertion loss is more important, than the circuit may be designed to efficiently couple one signal, while only partially reflecting the other signal. This optimization will of course depend upon the application and one skilled in the art can readily optimize the circuit using known optimization and simulation techniques and tools to create the desired performance.

Since the lengths of the transmission lines will therefore likely be adjusted from theoretical values to optimize insertion and isolation parameters, the two intersecting transmission lines 104, 105 and 106, 107 will not typically have a length which is a precise multiple of ¼ y and ¼ x, respectively. Rather, they will have a length that is "about" a multiple of ¼ y and ¼ x. The term "about" therefore is used in this context to indicate that this is not likely a precise multiple but rather an optimized/compromised number to strike a balance between coupling efficiency of one signal and isolation of the other. Generally, about ¼ y and about ¼ x is ¼ y±<⅛ y and ¼ x±<⅛ x, respectively, preferably, ¼ y±<1/16 y and ¼ x±<1/16 x, respectively, and, more preferably, ¼ y±<1/32 y and ¼ x±<1/32 x, respectively.

In a particularly preferred embodiment, the circuit 100 comprises: (a) a substrate 115; (b) first and second transmission lines 104, 106 intersecting on the substrate; (c) first, second and third ports 108, 109, 110 on the substrate 115, the first port 108 disposed at one end of the first transmission line 105*a*, the second port 109 being disposed at the intersection 103 of the first and second transmission lines 104*a*, 106*a*, the third port 110 being disposed at the end of the second transmission line 106*a*; (d) first and second stub transmission lines 105*a*, 107*a* on the substrate 115, each having a free end 111, 113 and a connected end, 112, 114, the connected end 112 of the first stub transmission line 105*a* being connected to the first transmission line 104*a* proximate the first port 108, the connected end 114 of the second stub transmission line 107*a* being connected to the second transmission line 106*a* proximate to the third port 110; and (e) wherein the first transmission line and the first stub transmission line have lengths which are a multiple of about ¼ y±<⅛ y, the second transmission line and the second stub transmission line having a length which is a multiple of ¼ x±<⅛ x.

The transmission lines may be configured for compactness. That is, rather than having essentially straight lines, it may be preferable to "fold" the lines to fit the circuit in a smaller package. For example, referring to FIG. 1, both the main and stub transmission lines are folded such that portions of each line are angled to one another. Specifically, the first transmission line 104*a* is folded in a U shape and the second transmission line 106*a* is folded in an L shape. Both stub transmission lines are folded in essentially U shapes. By folding the lines in this matter, the entire circuit fits into a smaller form factor. Although folding the transmission lines will make the circuit more compact, it should be recognized that angles in the lines tend to create loss. Therefore, it is desirable to minimize the number of bends. Further, it is preferable to chamfer the corners as shown in FIG. 1 to minimize losses. Such techniques are known in the art.

Moreover, in addition to being folded as shown in FIG. 1, the transmission lines can be made other shapes in an effort to provide compactness. For example, as illustrated in FIG. 8, a curved splitter/combiner is provided.

Figure 8:
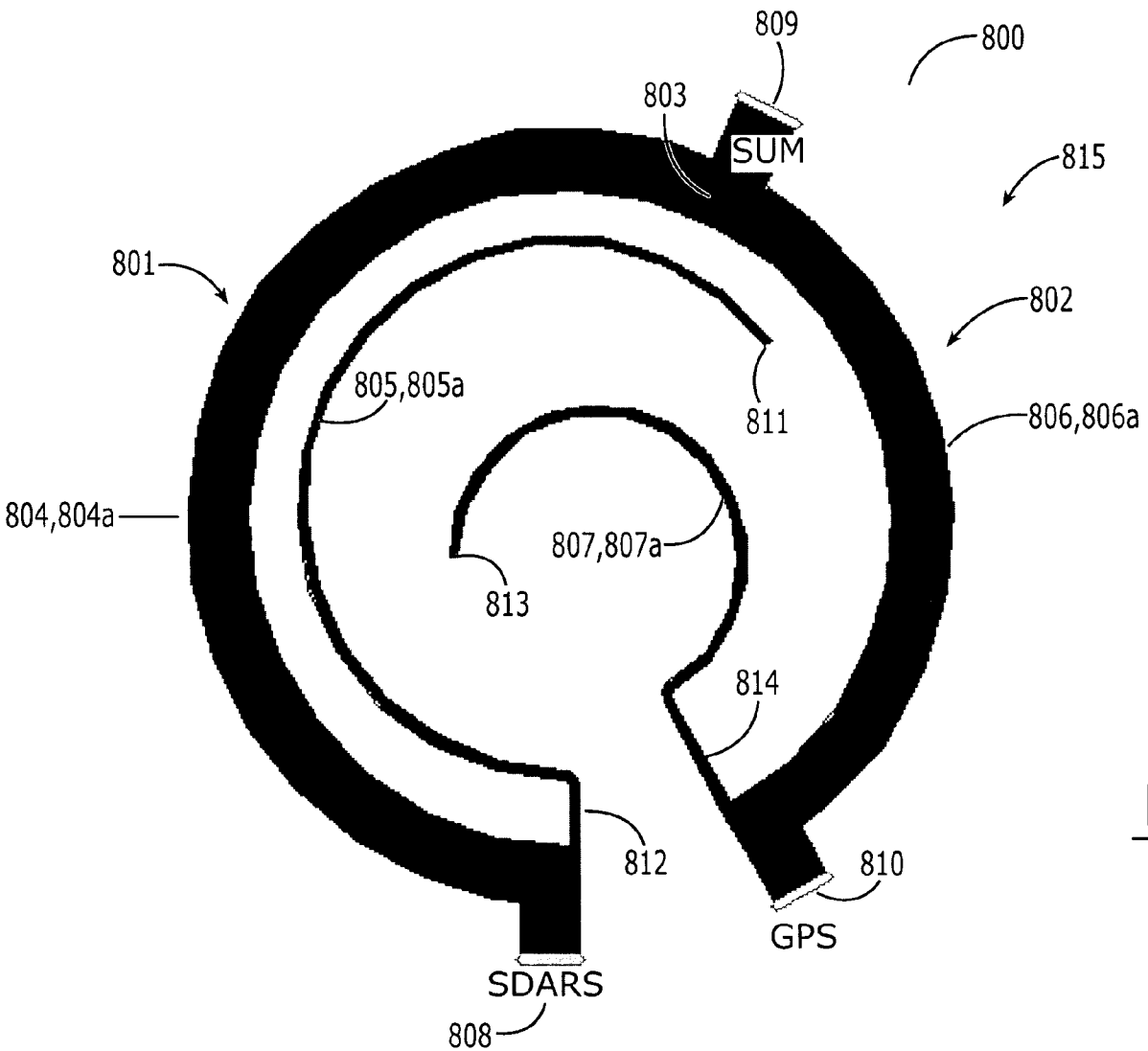
FIG. 8. shows an alternative printed diplexer layer of the present invention.
Figure 9:
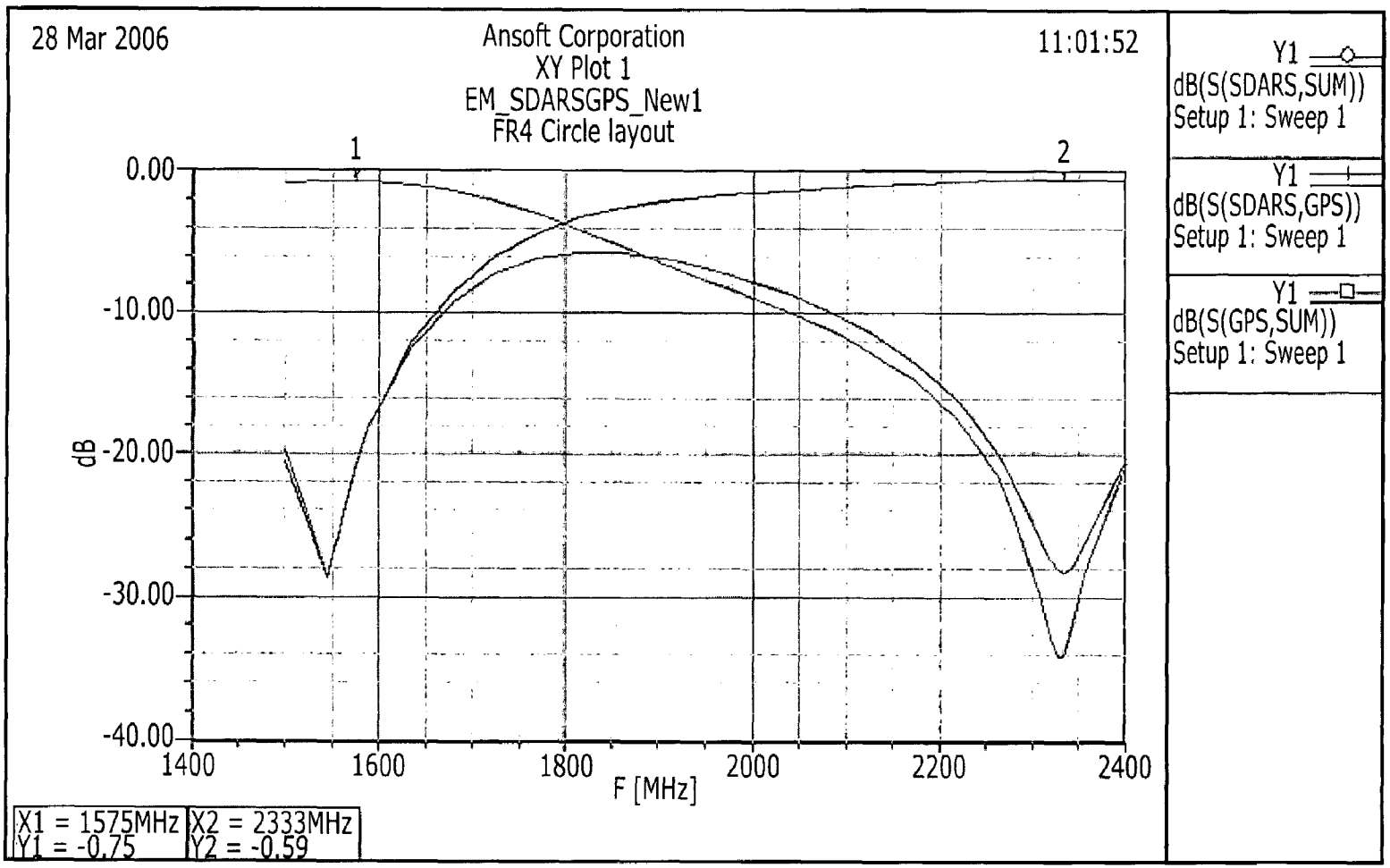
FIG. 9 shows circuit simulator results for the layout of FIG. 8, indicating insertion loss at markers 1 at 1.575 GHz and 2 at 2.333 GHz.

Referring to FIG. 8, a circuit 800 for combining/splitting first and second RF signals having different wavelengths of x and y, respectively, is shown. The circuit 800 comprises: (a) first and second transmission portions 801, 802, coupled at an intersection 803, the first transmission portion 801 comprising at least two intersecting transmission lines 804, 805, each having a length that is a multiple of about ¼ y, the second transmission portion 802 comprising at least two intersecting transmission lines 806, 807, each having a length which is a multiple of about ¼ x; and (b) first, second and third ports 808, 809, 810, the first port 808 located at the first transmission portion 801, the second port 809 located at the intersection 803 of the first and second transmission portions 801, 802, and the third port 810 being located at the second transmission portion 802, the first and second ports 808, 809 being electrically coupled, and the second and third ports 809, 810 being electrically coupled More specifically, the two intersecting transmission lines of the first transmission portion comprise at least a first transmission line 804*a* and a first stub transmission line 805*a* having a free end 811 and a connected end 812. The first port 808 is disposed at one end of the first transmission line 804*a* and the second port 809 is disposed at the other end of the first transmission line 804*a*. The connected end 812 of the first stub transmission line 805*a* is connected to the first transmission line 804*a* proximate the first port 808. Likewise, the two intersecting transmission lines of the second transmission portion comprises at least a second transmission line 806*a*, and a second stub transmission line 807*a* having a free end 813 and a connected end 814. The third port 810 is disposed at one end of the second transmission line 806*a* and the second port 809 is disposed at the other end of the second transmission line 806*a*. The connected end 814 of the second stub transmission line 807*a* is connected to the second transmission line 106*a* proximate the third port 810.

In a particularly preferred embodiment, the circuit 800 comprises: (a) a substrate 815; (b) first and second transmission lines 804, 806 intersecting on the substrate; (c) first, second and third ports 808, 809, 810 on the substrate 815, the first port 808 disposed at one end of the first transmission line 805*a*, the second port 809 being disposed at the intersection 803 of the first and second transmission lines 804*a*, 806*a*, the third port 810 being disposed at the end of the second transmission line 806*a*; (d) first and second stub transmission lines 805*a*, 807*a* on the substrate 815, each having a free end 811, 813 and a connected end, 812, 814, the connected end 812 of the first stub transmission line 805*a* being connected to the first transmission line 804*a* proximate the first port 808, the connected end 814 of the second stub transmission line 807*a* being connected to the second transmission line 806*a* proximate to the third port 810; and (e) wherein the first transmission line and the first stub transmission line have lengths which are a multiple of about ¼ y±<⅛ y, the second transmission line and the second stub transmission line having a length which is a multiple of ¼ x±<⅛x. FIGS. 9-13 provide additional simulation analysis of the FIG. 8 splitter/combiner. One could also readily appreciate that other curved splitter/combiners shapes are within the scope of the invention including but not limited to ovals, ellipses, and rounded rectilinear shapes.

The term "transmission line" is used broadly and collectively to refer to any known transmission line or waveguide. Preferably, the transmission line is a known transmission line such as, for example, a microstrip, a grounded coplanar waveguide, or a strip line. More preferably, the transmission line is a microstrip for ease of manufacturing and compactness. More particularly, the transmission lines and the stub transmission lines are printed on the substrate using known techniques. Furthermore, the use of microstrip technology facilitates integration with low noise amplifies (LNA) layouts in active antenna structures. Additionally, microstrips that do not have vias are preferred since active automotive antennas receive power from the receiver along the coaxial cable so the diplexer must provide a DC path to each antenna's LNA.

Preferably, the characteristic impedance of the transmission lines is lower than that of the stub transmission lines. This way, there is a tendency for current to flow down the main transmission lines. For example, good results are obtained when the impedance of the transmission lines is 50Ω and that of the stub transmission lines is 120Ω. In a preferred embodiment, the higher impedance is dictated by the width of the transmission lines such that the main transmission lines are substantially wider than the stub transmission lines.

Returning to a discussion of FIG. 1, the circuit 100 (as well as circuit 800) may comprise any standard substrate known facilitating transmission of signal in the frequency range of the given application. Such materials are well known and include, for example, silicon, silicon-based materials, ceramic (e.g., aluminates), Teflon-based materials, and epoxy composites, or any other printed wire board (PWB) material. If the waveguide is a hollow waveguide, the substrate may be air.

In its use as a diplexer for multifunction antennas, the circuit 100 may be incorporated into larger packages such as the antenna system and/or the receiver/GPS housings, or it may be packaged as a discrete component. For example, one such component may be attached to the antennas at one end of a coaxial cable and another component to the receiver/GPS components at the other end of the cable.

The operation of the circuit 100 of FIG. 1 will now be considered. Note that the operation of FIG. 8 is identical, the only difference being its shape. A first RF signal having a wavelength of x is introduced at one of the first port or the second port. (If the circuit 100 is being used as a splitter, then the signal is introduced at the second port, and, if it is being used as a combiner, then the signal is introduced in at the first port.) Upon introduction in the circuit, the signal forms a first standing wave in the second transmission portion, thereby preventing the first RF signal from propagating through the second transmission portion and out of the third port. In this embodiment, the first standing wave is formed in the second transmission portion 102 by reflecting the first RF signal at high impedance free end 113 of stub transmission line 107*a* approximately ¼ x wave length along second stub transmission line 107*a* creating a low impedance to first RF signal at intersection 116 of the second transmission line 106*a*, thereby preventing the first RF signal from propagating out the third port 110. The first RF signal then travels approximately an additional ¼ x wavelength along second transmission line 106*a* to intersection 103 creating a high impedance to first RF signal thereby preventing the first RF signal from propagating through second transmission path. In so doing, essentially the entire first RF signal is outputted at either the first port (in the case of a splitter) or the second port (in the case of a combiner).

Likewise, either concurrently or at a different time from the introduction of the first RF signal, a second RF signal having a wavelength of y may be introduced at either the third port (in the case of a combiner) or the second port (in the case of a splitter). The combination of the first transmission portion's configuration and the wavelength of the second RF causes a second standing wave to form in the first transmission portion, thereby preventing the second RF signal from propagating through the first transmission portion and out the first port. The second standing wave is formed in the first transmission portion 101 by reflecting the second RF signal at high impedance free end 111 of stub transmission line 105*a* approximately ¼ y wave length along second stub transmission line 105*a* creating a low impedance to second RF signal at intersection 117 of the first transmission line 104*a* thereby preventing the second RF signal from propagating out the first port 108. The second RF signal then travels approximately an additional ¼ y wave length along first transmission line 104*a* to intersection 103 creating a high impedance to second RF signal thereby preventing the second RF signal from propagating through first transmission path. The second RF signal is thus forced to output the circuit from either the third port (in the case of a splitter) or the second port (in the case of a combiner). Preferably, the first RF signal propagates between the first and second ports without passing through a filter, and the second RF signal propagates between the third and the second ports without passing through a filter.

Preferably, the wavelengths of the signals are sufficiently different such that their transmission through the circuit 100 will be sufficiently different as well as to separate the signals. Preferably, the x and y differ by at least ±⅛ x, more specifically, x and y differ by about ±¼ x. In a particular application, y is about 1.5x. In this embodiment, y may a GPS wavelength (1.575 GHz) and x may a SDARS wavelength (2.32-2.34 GHz). The circuit of the present invention operates particularly well at these frequencies since they are essentially spot frequencies, thus lending themselves to the use of narrow band open-ended stubs.

Preferably, the first and second signal are the same type of signal—i.e., either bidirectional or unidirectional. For example, it is preferred to group together two receive-only functions (e.g., SDARS and GPS), and two bi-directional functions (e.g., AMPS and PCS).

EXAMPLES

The following simulations show the ability of the circuit of the present invention to combine/split signals based on the propagation characteristics of signals having different wavelengths within the same circuit without the need for filters or other discrete components.

Example 1

Based on the principles of the present invention described above, a combiner/splitter circuit shown in FIG. 1 was designed and optimized using Ansoft Designer™ software on a 30 mil thick, $\epsilon r$=3.2, tan $\delta$=0.003 substrate. Care was taken during the design process to minimize size, discontinuities, and insertion loss making appropriate trade-offs were necessary.

Because the microstrip lines connecting the ports must also carry DC current, wider 50Ω lines were used. Narrower higher impedance lines could have been used due to the narrow operating bandwidth for compactness, but this does more to increase insertion loss and limit the DC current capacity.

The open stubs were kept as straight as practically possible to maximize their effective Q but sufficiently spaced from, the 50Ω lines to minimize coupling. Their stub impedances were kept intentionally high, 120Ω, to minimize conductor and substrate losses and also minimize out of band loading of the 50Ω lines.

With the layout complete, the stub and transformer lengths were simultaneously optimized using the optimization engine within Ansoft Designer™. The optimization goal was set for S21 and S23 equal to zero. The optimized final layout is shown in FIG. 1 with the GPS and SDARS inputs on ports 110 and 108 respectively. The overall dimension of the layout is 27 mm×20 mm.

Figure 2:
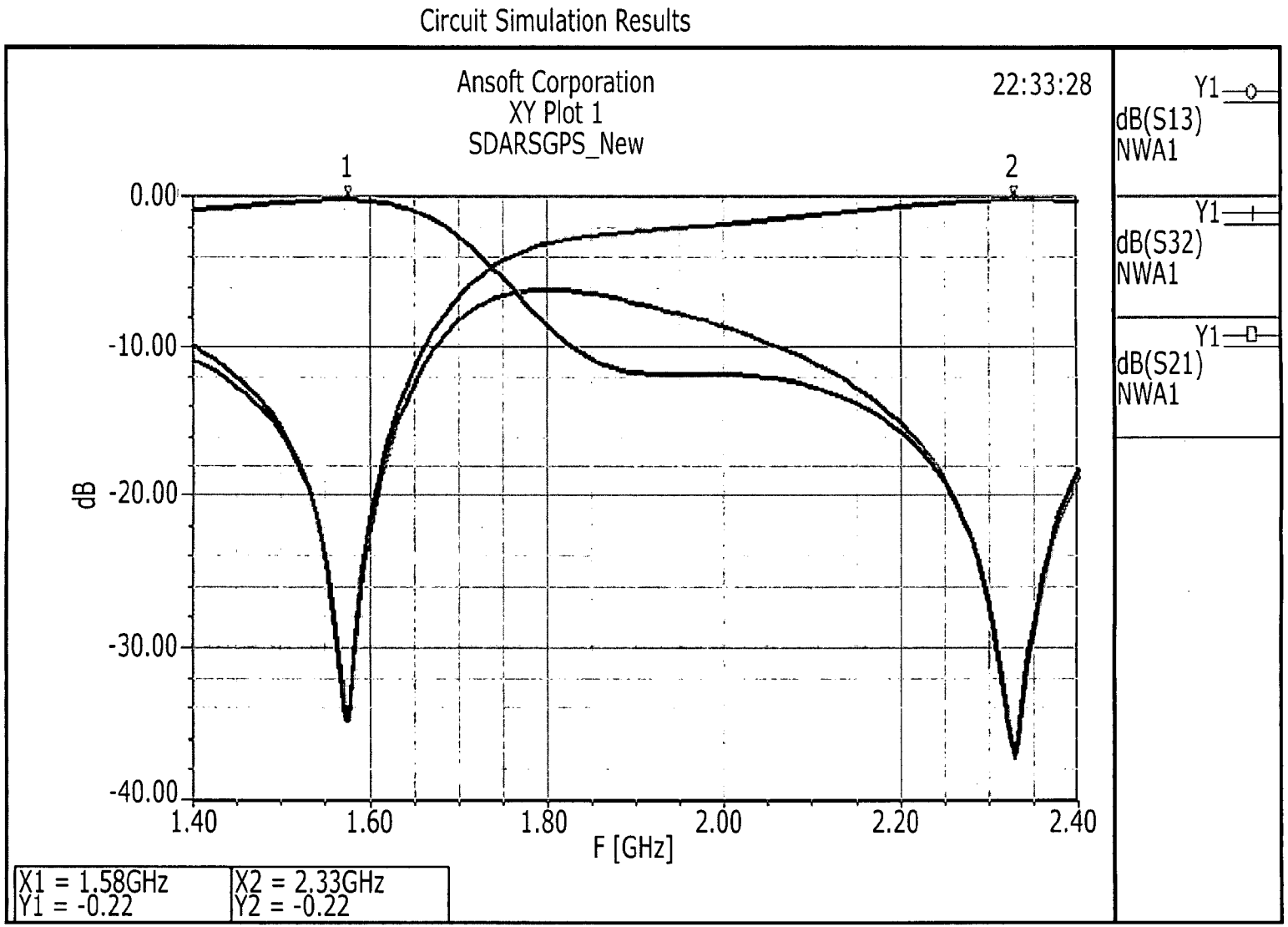
FIG. 2 shows circuit simulator results for the layout of FIG. 1, indicating equal insertion loss of 0.22 dB at markers 1 at 1.575 GHz and 2 at 2.333 GHz.
Figure 3:
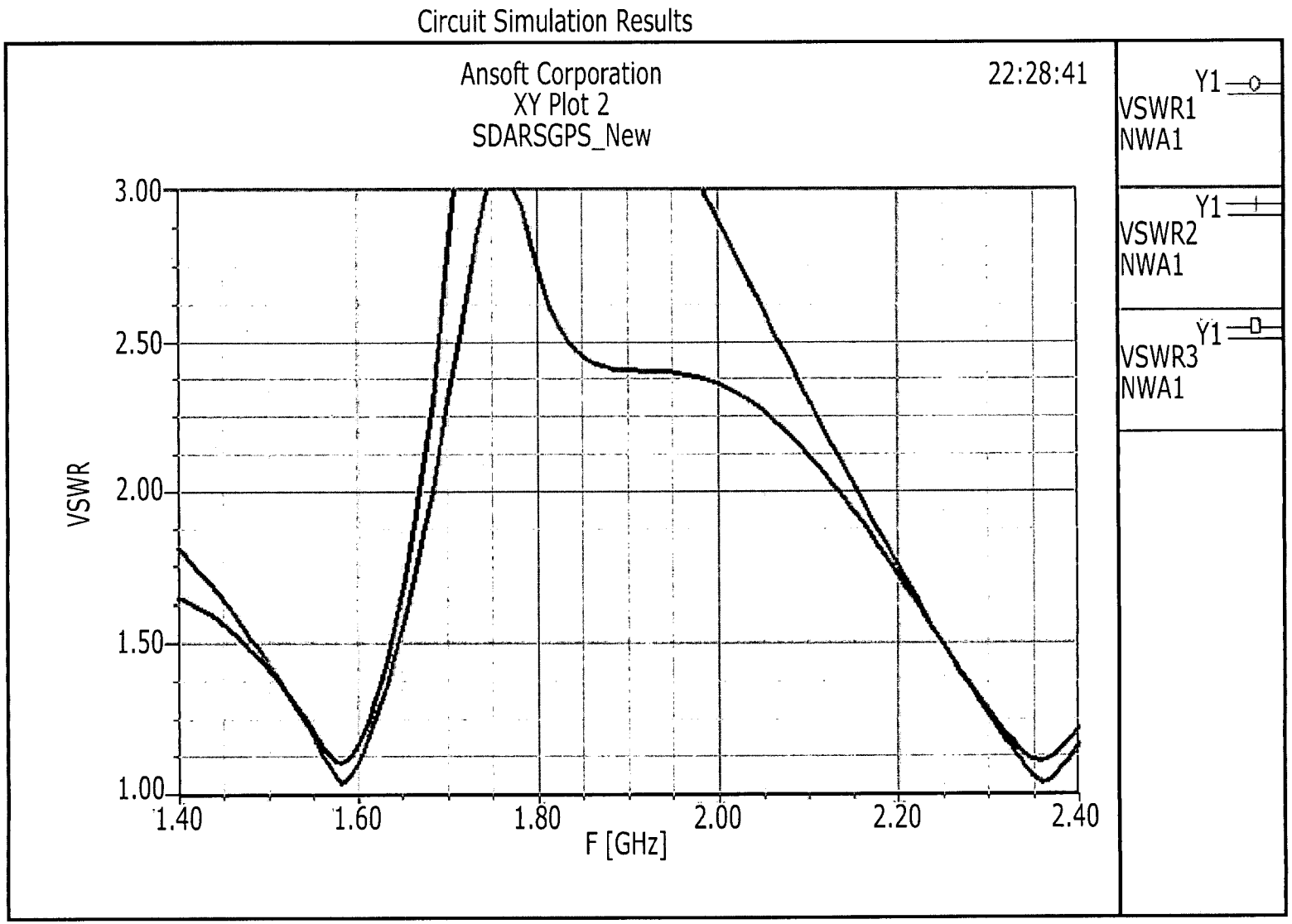
FIG. 3 shows circuit simulator results for the layout of FIG. 1, indicating VSWR vs. frequency.

1 GHz to 2 GHz swept frequency circuit simulation was conducted to show the optimized network performance. These results indicate an equal insertion loss of 0.22 dB and more than 20 dB isolation as shown in FIG. 2. The VSWR plot is shown in FIG. 3.

Figure 4:
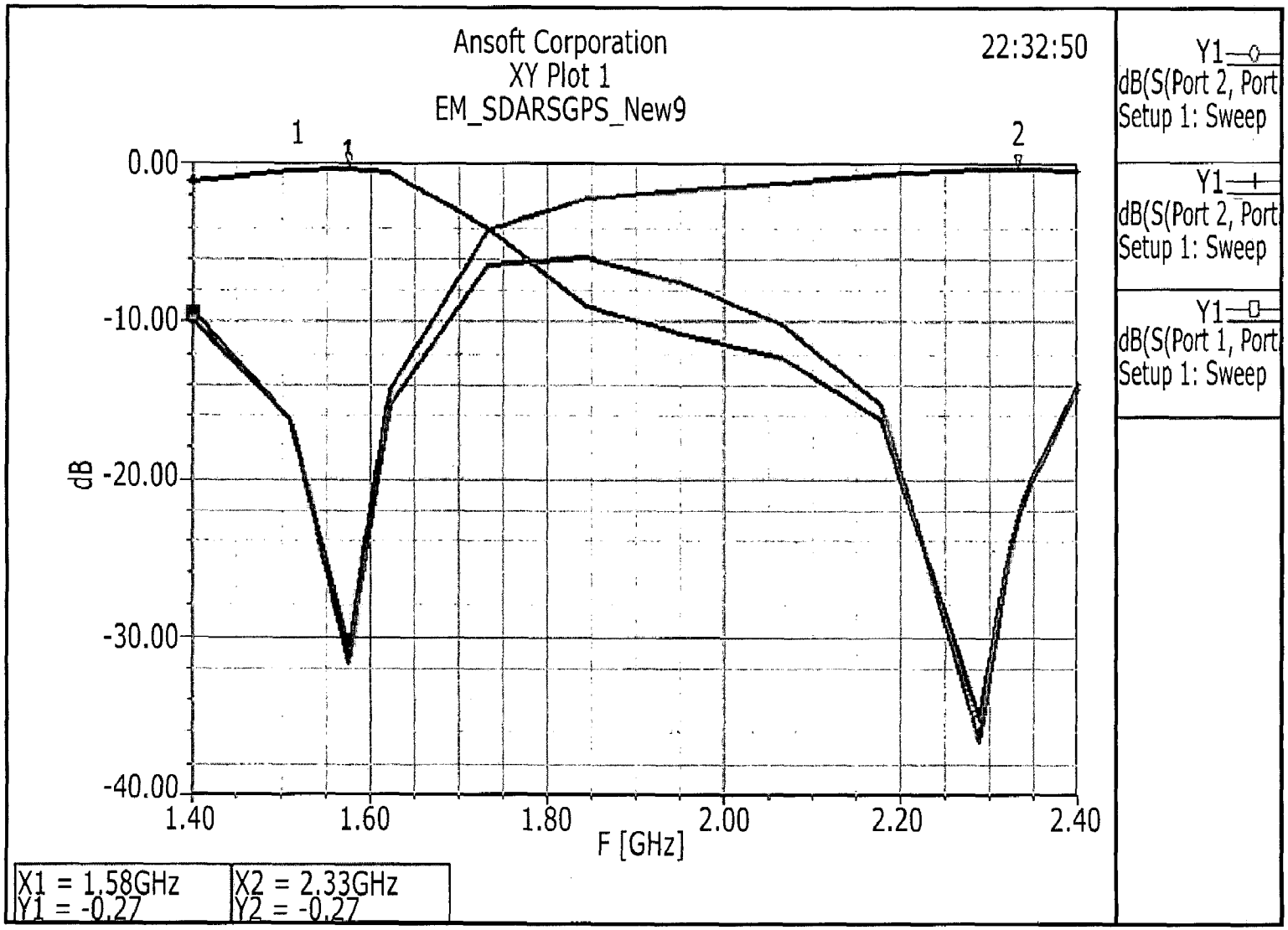
FIG. 4 shows finite element method (FEM) simulation results for the layout of FIG. 1, indicating equal insertion loss of 0.27 dB at markers 1 at 1.575 GHz and 2 at 2.333 GHz.
Figure 5:
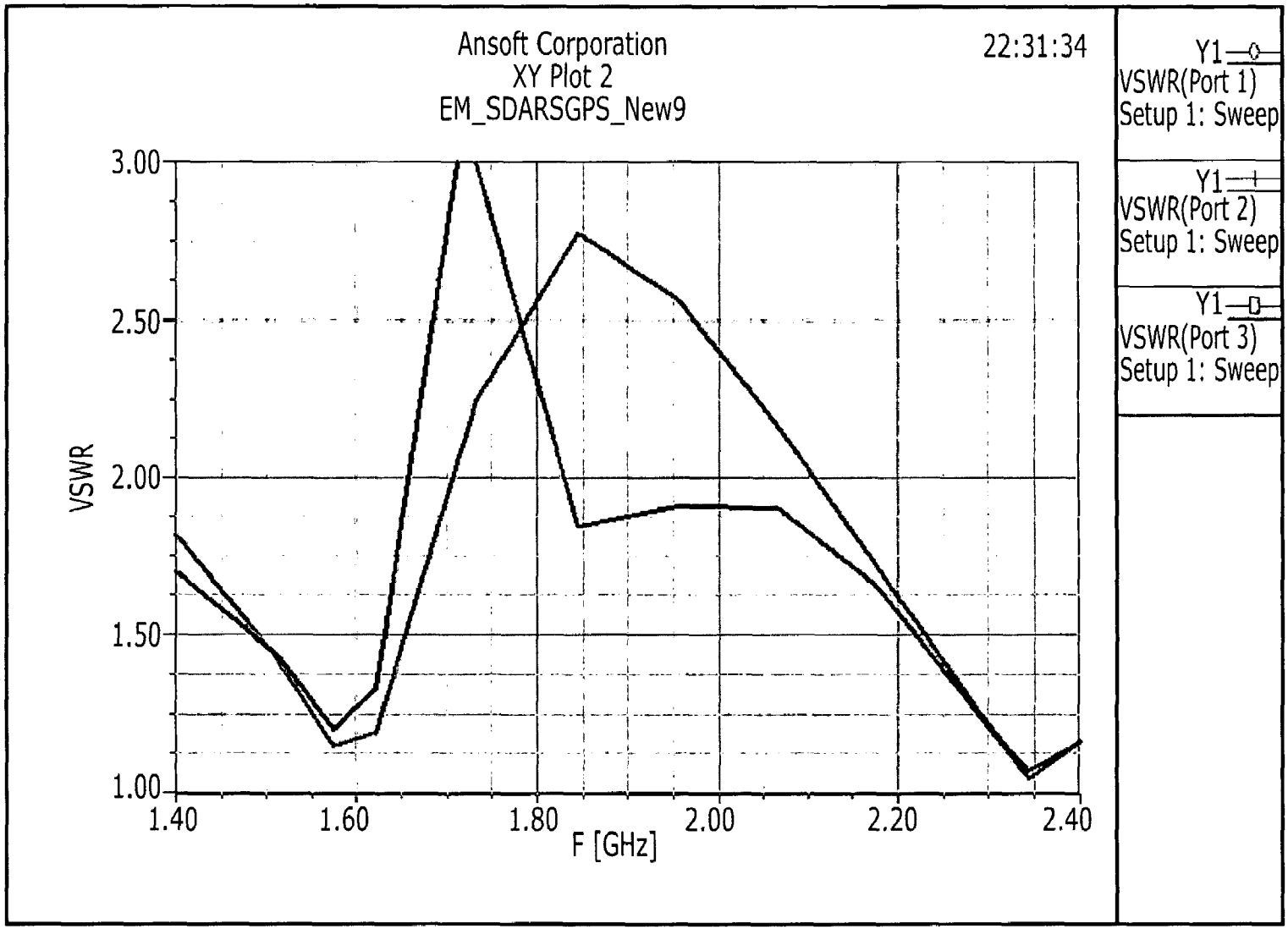
FIG. 5 shows FEM simulation results for the layout of FIG. 1, indicating VSWR vs. frequency.

Although these results shown an impressive level of isolation, the circuit model used in the simulation did not have the necessary elements to account for coupling. To investigate any possible coupling between the stubs and the transformers, the 2.5 D FEM (finite element modeling) simulator also built into Ansoft's Designer™ was utilized. The 2.5 D FEM results are shown in FIGS. 4 and 5. As shown, the circuit and 2.5 D FEM simulations agree very well and indicate little to no coupling exists between the stubs and transformers. Specifically, as shown in FIG. 4, there is an insertion loss of 0.27 dB for both marker 1 (GPS port) and marker 2 (SDARS port). The SDARS port isolation at GPS frequency is about 30 dB, while the GPS port isolation at SDARS frequency is about 22 dB.

Figure 6:
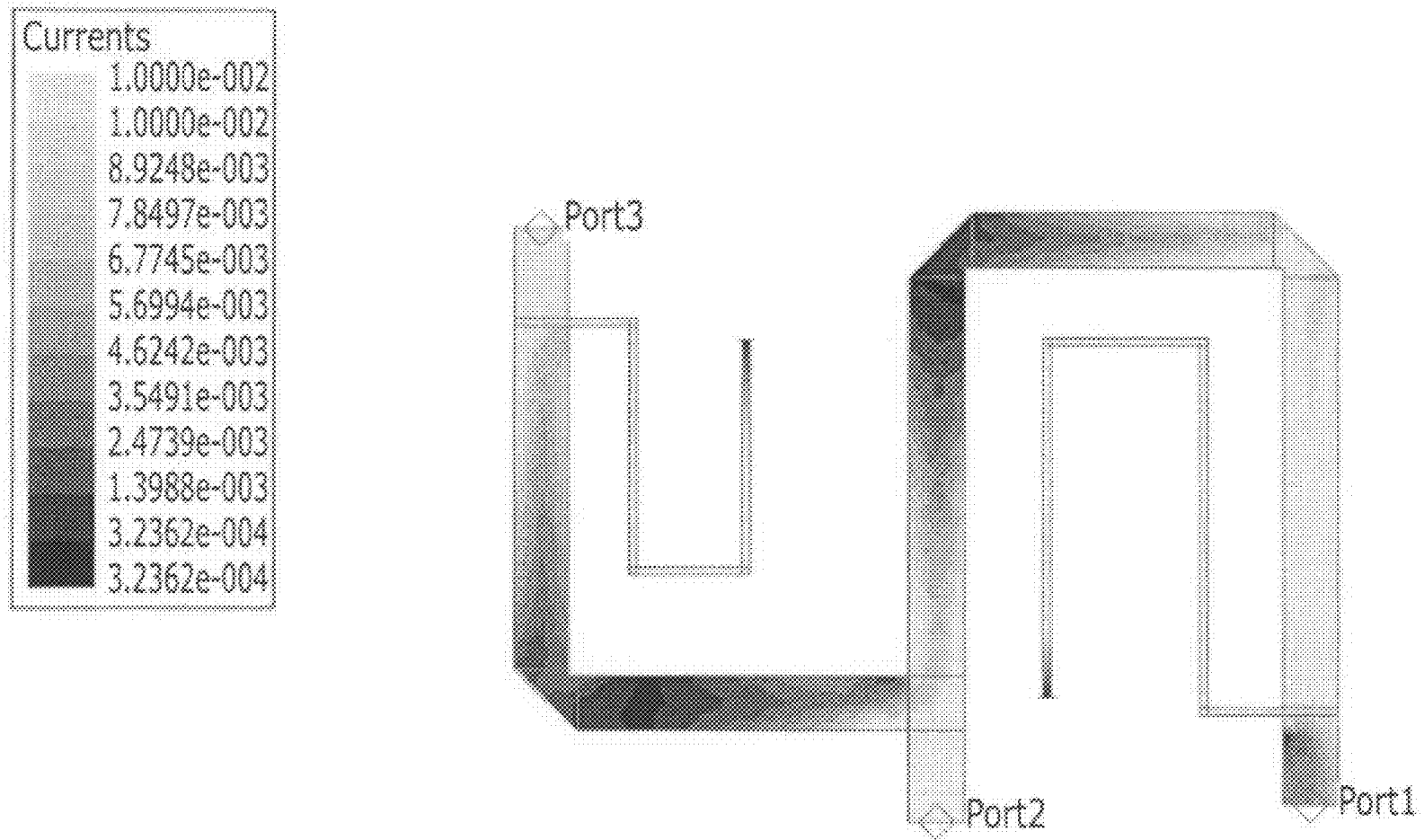
FIG. 6 shows a circuit current distribution for the layout of FIG. 1 at 1.575 GHz showing S23 transmission.
Figure 7:
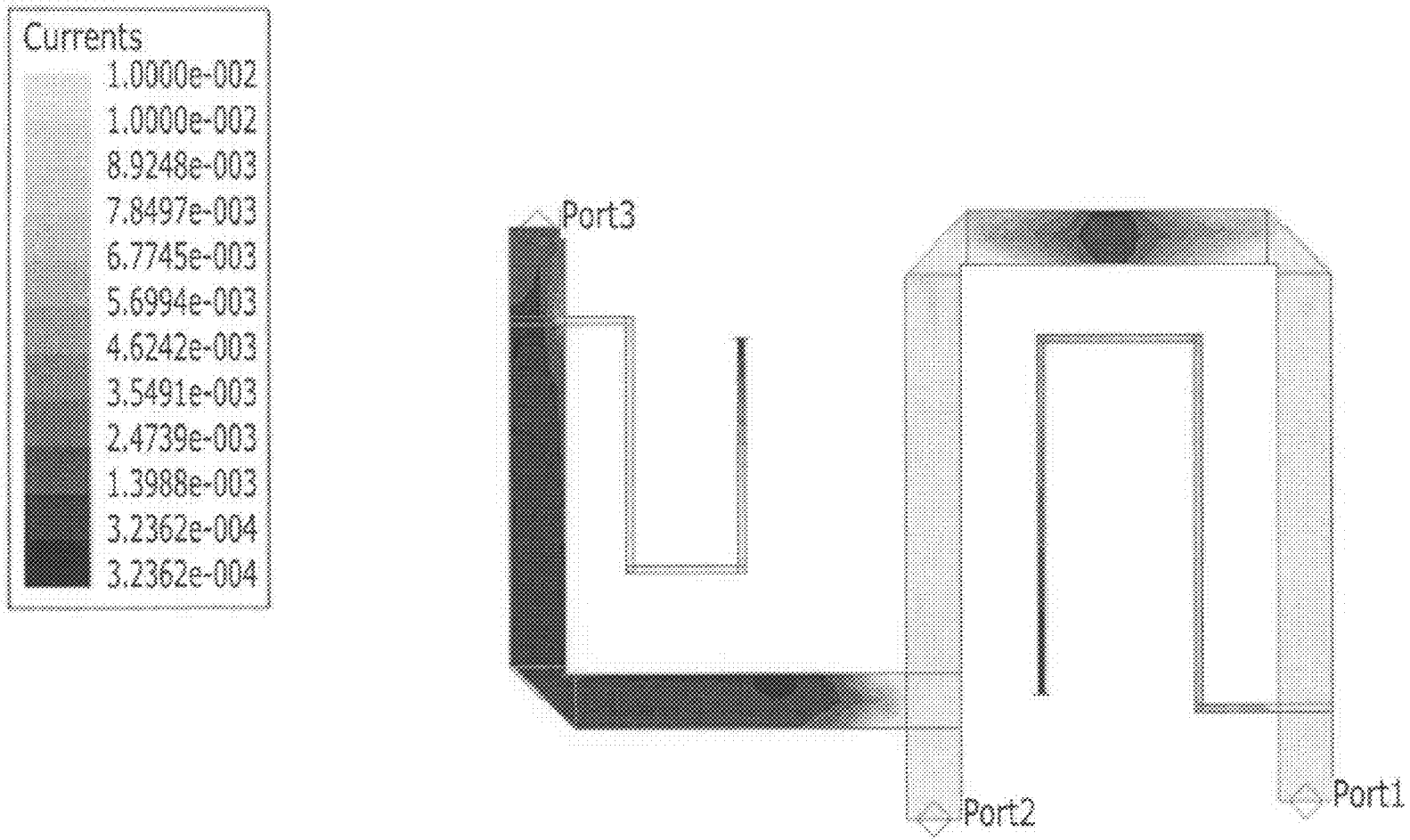
FIG. 7 shows a circuit current distribution for the layout of FIG. 1 at 2.333 GHz showing S21 transmission.

Furthermore, FIGS. 6 and 7 show the current distribution on the network at 1.575 GHz and 2.333 GHz respectively. As shown, in FIG. 6, when the 1.575 GHz signal is applied to the second port, there is very little current flow, indicated by dark region, at the first port while the second and third ports have high current, bright regions indicating that most of the signal is exiting the third port. Likewise, referring to FIG. 7, when the 2.333 GHz signal is applied to the second port, there is very little current flow at the third port and high current flow at the first port indicating that most of the signal is exiting the first port.

Example 2

A combiner/splitter circuit having the configuration shown in FIG. 8 was designed and optimized using the same software and design parameters as in Example 1 except obviously for geometry.

A 1 GHz to 2 GHz swept frequency circuit simulation was conducted to show the optimized network performance. The 2.5 D FEM shown in FIG. 9 insertion loss of 0.75 dB for marker 1 (GPS port) and −0.59 dB for marker 2 (SDARS port). The SDARS port isolation at GPS frequency is about 23 dB, while the GPS port isolation at SDARS frequency is about 28 dB.

Figure 10:
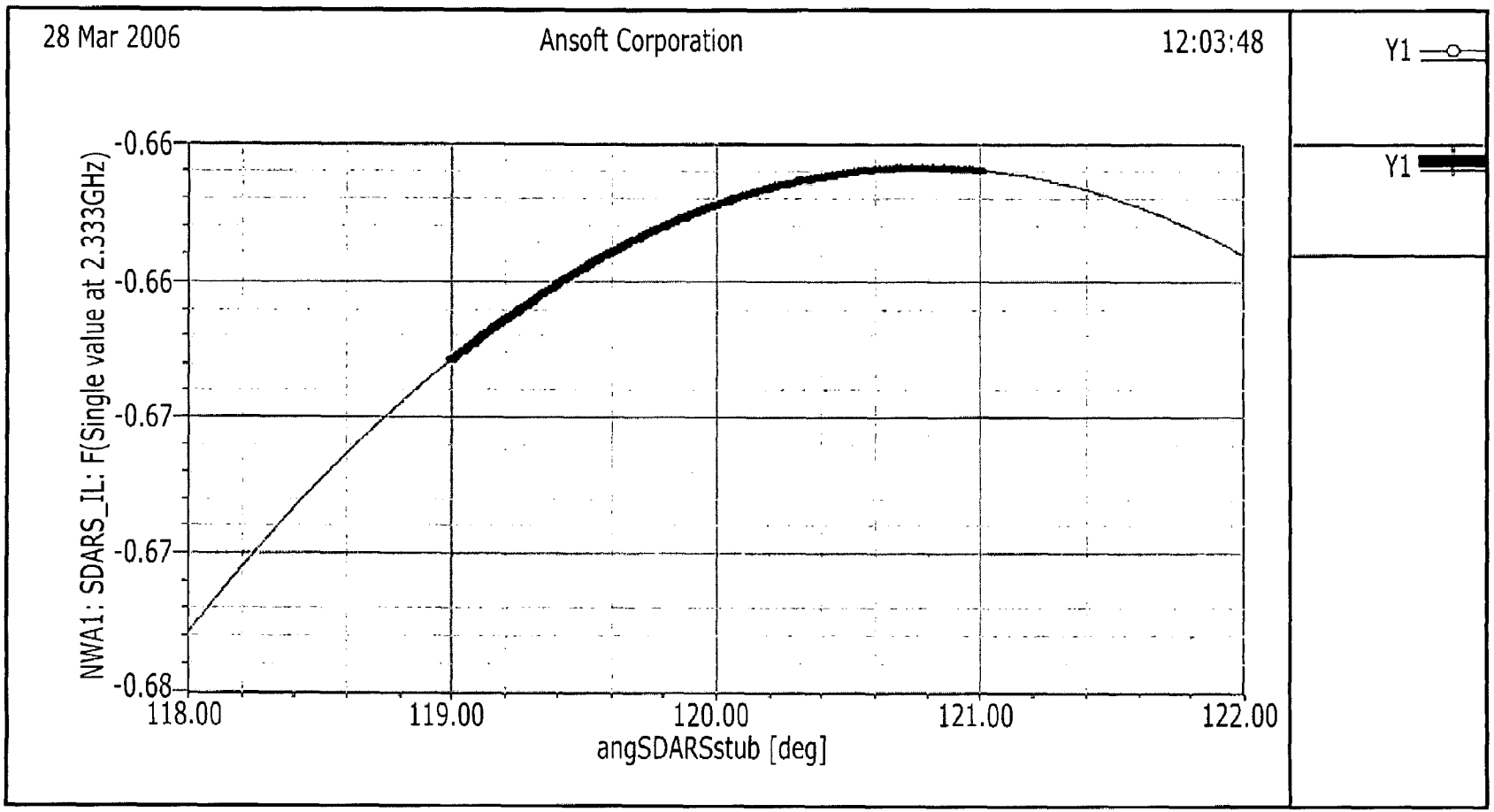
FIGS. 10-13 show other characteristics relating to the printed diplexer illustrated in FIG. 8.
Figure 11:
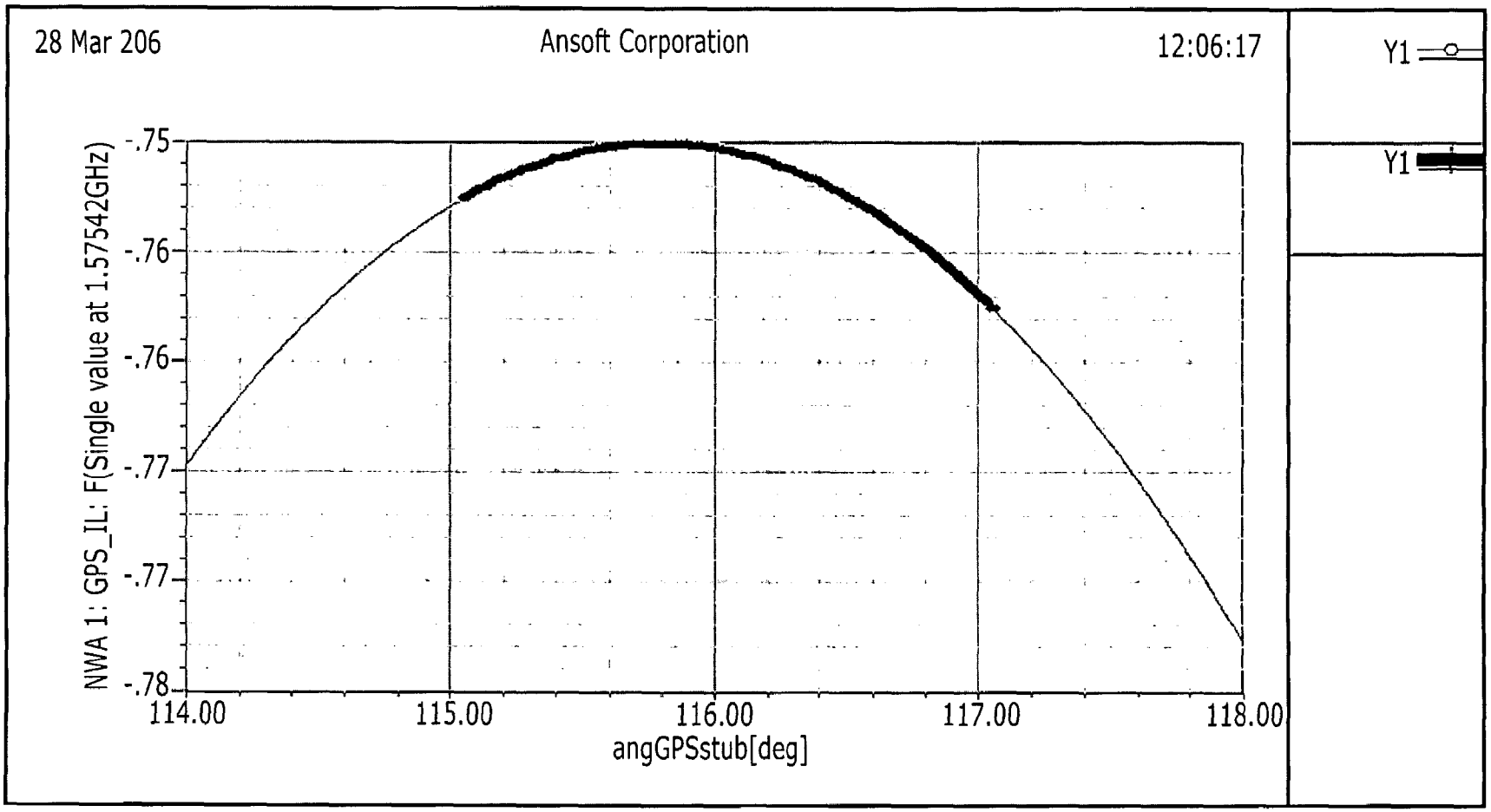
Figure 12:
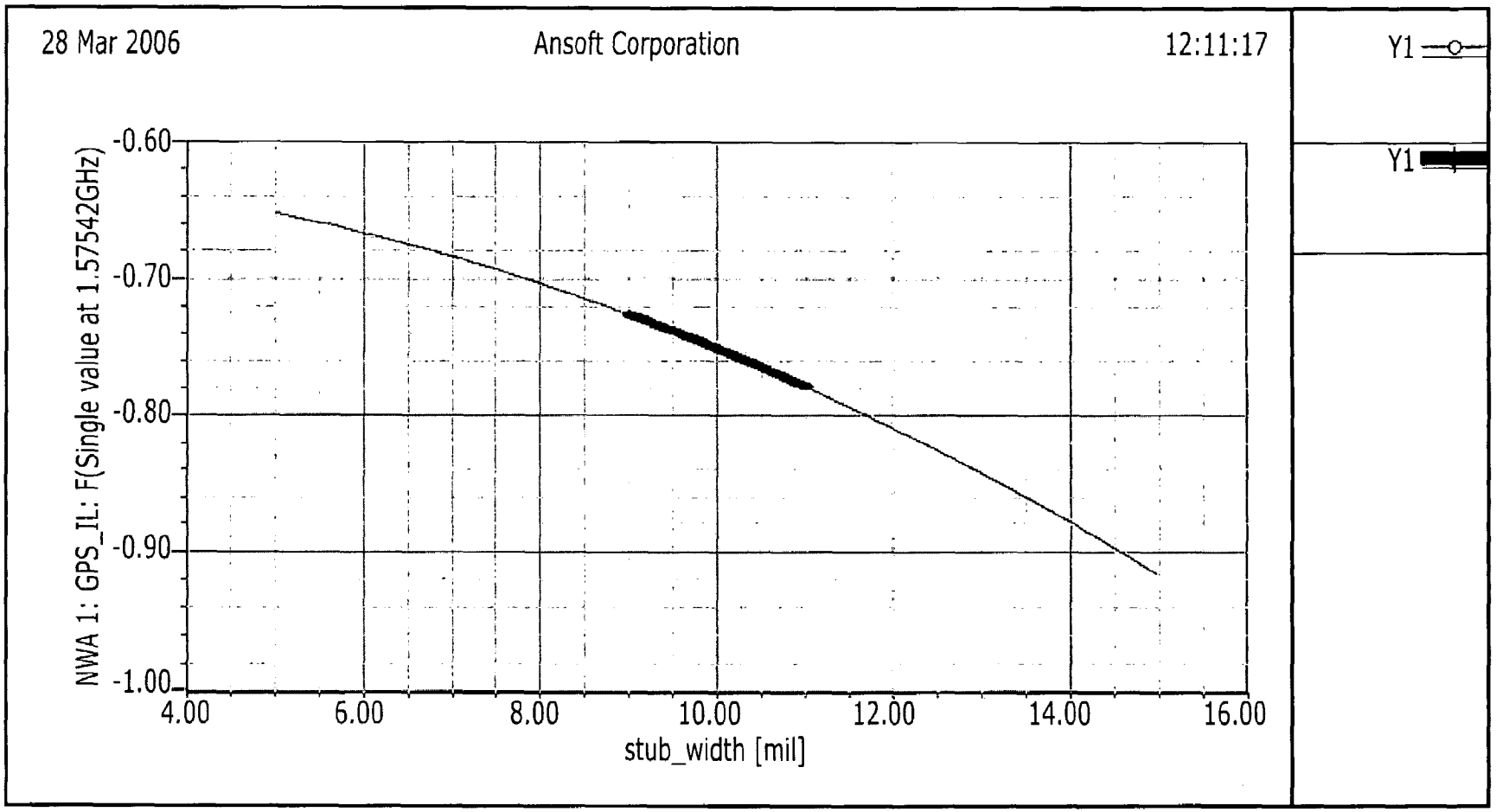
Figure 13:
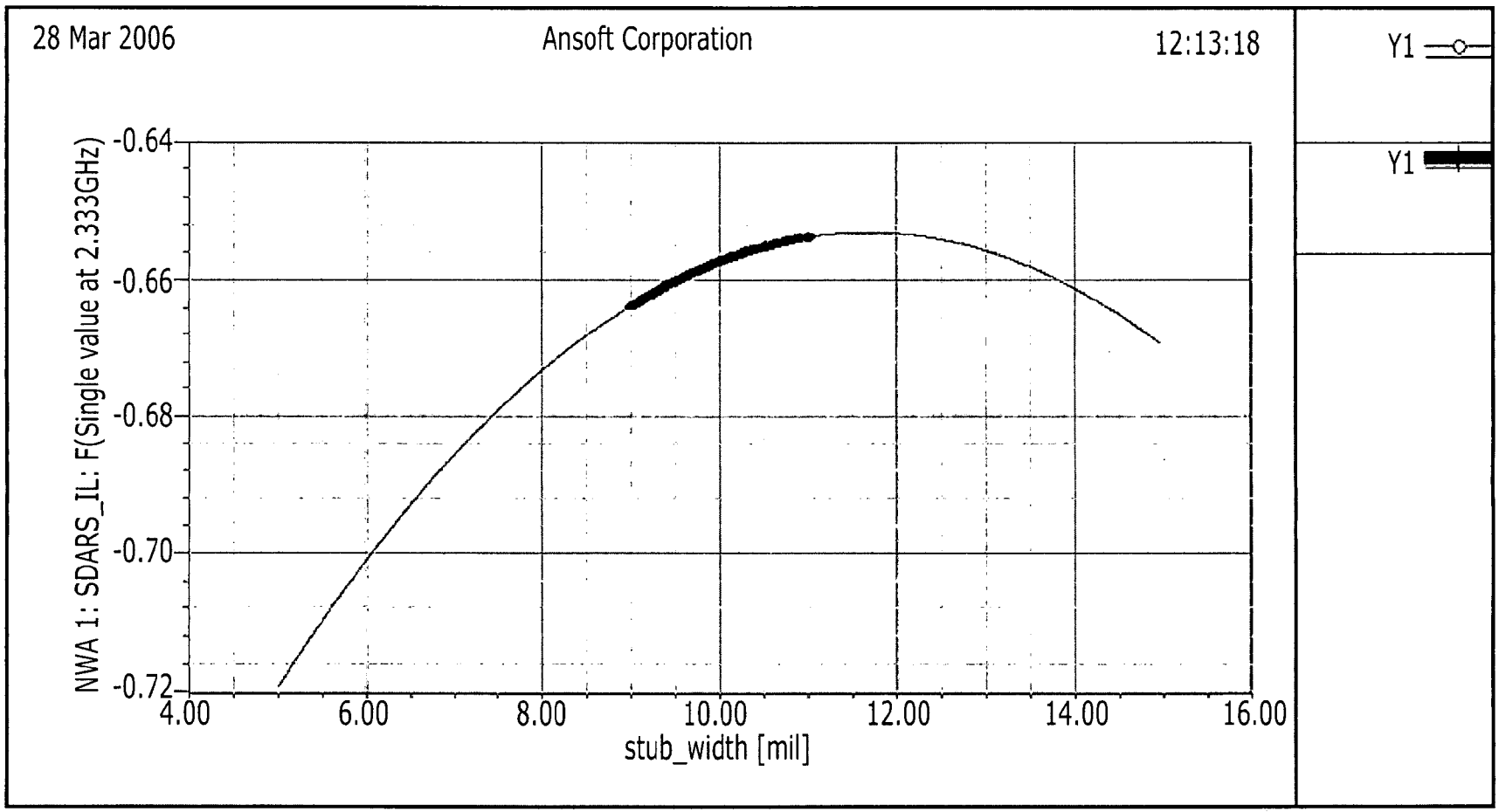

FIGS. 10-13 show the manufacturing tolerances afforded by the configuration of FIG. 8. Referring to FIGS. 10 and 11, the tolerance in the length of the arc of the SDARS and GPS stubs is shown, respectively. In each case, a deviation of ±2 degrees from the center nominal angle (i.e., 240° and 232°, respectively) does not have a significant effect on the insertion loss. Referring to FIGS. 12 and 13, the thickness of the stubs can range ±1 mil from the nominal thickness (i.e., 10 mils for each) without significantly affecting insertion loss. The tolerance in the length and width of the stubs indicates a high degree of manufacturability of this circuit design.

What is claimed is:

1. A circuit for combining/splitting a first RF signal having wavelength of x, and a second RF signal having a wavelength of y, said circuit comprising:

first and second transmission portions coupled at an intersection, said first transmission portion comprising at least two intersecting transmission lines, each having a length which is an odd multiple of about ¼ y, said second transmission portion comprising at least two intersecting transmission lines, each having a length which is an odd multiple of about ¼ x, wherein x and y differ by a multiple of ½ x±⅛ x; and first, second and third ports, said first port located at said first port transmission portion, said second port located at said intersection of said first and second transmission portions, and said third port being located at said second transmission portion, said first and second ports being electrically coupled, and said second and third ports being electrically coupled.

2. The circuit of claim 1, wherein there are no filters along the electrical coupling between said first and second ports and said second and third ports.

3. The circuit of claim 2, wherein said at least two intersecting transmission lines of said first transmission portion comprise at least:

a first transmission line, said first port being disposed at one end of said first transmission line and said second port being disposed at the other end of said first transmission line; and a first stub transmission line having a free end and a connected end, said connected end of said first stub transmission line being connected to said first transmission line proximate said first; and wherein said at least two intersecting transmission lines of said second transmission portion comprises at least:

a second transmission line, said third port being disposed at one end of said second transmission line and said second port disposed at the other end of said second transmission line; and a second stub transmission line having a free end and a connected end, said connected end of said second stub transmission line being connected to said second transmission line proximate said third port.

4. The circuit of claim 1, wherein y is about 1.5 x.

5. The circuit of claim 4, wherein y is a GPS wavelength and x is a SDARS wavelength.

6. A circuit for circuit for combining/splitting first RF signal having a wavelength of x, and a second RF signal having a wavelength of y, said circuit comprising:

a substrate;

first and second transmission lines intersecting on said substrate first, second and third ports on said substrate, said first port disposed at one end of said first transmission line, said second port being disposed at the intersection of said first and second transmission lines, said third port being disposed at the end of said second transmission line;

first and second stub transmission lines on said substrate, each having a free end and a connected end, said connected end of said first stub transmission line being connected to said first transmission line proximate said first port, said connected end of said second stub transmission line being connected to said second transmission line proximate to said third port; and wherein said first transmission line and said first stub transmission line having a length which is an odd multiple of about ¼ y±<⅛ y, said second stub transmission line having a length which is an odd multiple of ¼ x±<⅛ x, wherein x and y differ by a multiple of ½ x±⅛x.

7. The circuit of claim 6, wherein said first transmission line comprises no filters between said first and second ports.

8. The circuit of claim 6, wherein said second transmission line comprises no filters between said third and second ports.

9. The circuit of claim 6, wherein y is about 1.5 x.

10. The circuit of claim 9, wherein y is a GPS wavelength and x is a SDARS wavelength.

11. The circuit of claim 6, wherein said transmission line is selected from one or more of a microstrip, a grounded coplanar waveguide, or a strip line.

12. The circuit of claim 11, wherein the characteristic impedance of said transmission lines is lower than that of said stub transmission lines.

13. The circuit of claim 12, wherein said transmission lines are substantially wider than said stub transmission lines.

14. The circuit of claim 13, wherein said transmission lines are 50 Ω and said stub transmission lines are 120 Ω.

15. The circuit of claim 6, wherein at least one of said transmission lines or at least one of said stub transmission lines comprise two or more portions at an angle to one another.

16. The circuit of claim 6, wherein at least one of said transmission lines or at least one of said stub transmission lines are curved.

17. The circuit of claim 16, wherein said circuit is generally circular.

18. The circuit of claim 6, wherein said substrate is selected from the group consisting of silicon, silicon-based materials, ceramic, aluminates, polytetrafluoroethylene based, epoxy composite, and air in the case of waveguide.

19. The circuit of claim 6, wherein said transmission lines and said stub transmission lines are printed on said substrate.

20. A method of combining/splitting a first RF signal having a wavelength of x, and a second RF signal having a wavelength of y using a circuit having first and second transmission portions, and first, second and third ports, said first port located at said first transmission portion, said third port being located at said second transmission portion, and said second port being between said first and second transmission portions, said method comprising:

introducing a first RF signal having a wavelength of x at one of said first port or said second port;

transmitting said first RF signal along said first transmission portion, said first transmission portion having a length which is an odd multiple of about ¼ y±<⅛ y, wherein x and y differ by a multiple of ½ x ±⅛x;

forming a first standing wave of said first RF signal in said second transmission portion, thereby preventing said first RF signal from propagating through said second transmission portion and out of said third port; and outputting said first RF signal at the other of said first port or said second port.

21. The method of claim 20, wherein said standing wave is formed in said second transmission portion by reflecting said first RF signal at a free end of a second stub transmission line approximately ¼ x wavelength along said second stub transmission line creating a low impedance to said first RF signal at an intersection of a second transmission lines and said second stub transmission line, thereby preventing the first RF signal from propagating out said third port, said first RF signal then travels approximately an additional ¼ x wavelength along said second transmission lines to an intersection of a first transmission line and said second transmission lines creating a high impedance to said first RF signal, thereby preventing the first RF signal from propagating through second transmission portion.

22. The method of claim 20, wherein said second transmission line and said second stub transmission line have a length which is an odd multiple of about ¼ x±<⅛ x.

23. The method of claim 20, further comprising:

introducing a second RF signal at one of said third port or said second port;

forming a second standing wave of said second RF signal in said first transmission portion, thereby preventing said second RF signal from propagating through said first transmission portion and out said first port; and outputting said second RF signal at the other of said third port or said second port.

24. The method of claim 23, wherein said first RF signal propagates to said other of said first or said second ports without passing through a filter.

25. The method of claim 23, wherein said second RF signal propagates to said other of said third or said second ports without passing through a filter.

26. The method of claim 23, wherein said second standing wave is formed in said first transmission portion by reflecting said second RF signal at a free end of a first stub transmission line approximately ¼ y wavelength along said first stub transmission line creating a low impedance to said second RF signal at an intersection of a first transmission lines and said first stub transmission line, thereby preventing the second RF signal from propagating out said first port, said second RF signal then travels approximately an additional ¼ y wavelength along said first transmission lines to an intersection of said first transmission line and a second transmission lines creating a high impedance to said second RF signal, thereby preventing the second RF signal from propagating through first transmission portion.

27. The method of claim 23, wherein said first transmission portion comprises at least:

a first transmission line, said first port being disposed at one end of said first transmission line and said second port being disposed at the other end of said first transmission line, said first transmission portion having a length which is an odd multiple of about ¼ y; and a first stub transmission line having a free end and a connected end, said connected end of said first stub transmission line being connected to said first transmission line proximate said first port and having a length which is an odd multiple of about ¼ y; and wherein said second transmission portion comprises at least:

a second transmission line, said third port being disposed at one end of said second transmission line and said second port disposed at the other end of said second transmission line, said second transmission portion having a length which is an odd multiple of about ¼ x; and a second stub transmission having a free end and a connected end, said connected end of said second stub transmission line being connected to said second transmission line proximate said third port and having a length that is an odd multiple of about ¼ x.

28. The circuit of claim 20, wherein y is about 1.5 x.

29. The circuit of claim 28, wherein y is a GPS wavelength and x is a SDARS wavelength.

* * * * *